US009945164B2

(12) United States Patent
Perkins et al.

(10) Patent No.: US 9,945,164 B2
(45) Date of Patent: Apr. 17, 2018

(54) VEHICLE DOOR LATCH

(71) Applicants: Donald M. Perkins, Sterling Heights, MI (US); Ian Dow, Bloomfield, MI (US); Robert Milne, Sterling Heights, MI (US); Francisco Vazquez, Chihuahua (MX); Eduardo Estrada, Chihuahua (MX); Carlos Tostado, Chihuahua (MX)

(72) Inventors: Donald M. Perkins, Sterling Heights, MI (US); Ian Dow, Bloomfield, MI (US); Robert Milne, Sterling Heights, MI (US); Francisco Vazquez, Chihuahua (MX); Eduardo Estrada, Chihuahua (MX); Carlos Tostado, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 330 days.

(21) Appl. No.: 14/938,668

(22) Filed: Nov. 11, 2015

(65) Prior Publication Data

US 2016/0060925 A1 Mar. 3, 2016

Related U.S. Application Data

(62) Division of application No. 13/549,389, filed on Jul. 13, 2012, now Pat. No. 9,194,162.

(Continued)

(51) Int. Cl.

*E05C 19/10* (2006.01)
*E05C 19/12* (2006.01)

(Continued)

(52) U.S. Cl.

CPC ..... *E05C 19/12* (2013.01); *E05B 77/06* (2013.01); *E05B 77/12* (2013.01); *E05B 81/28* (2013.01);

(Continued)

(58) Field of Classification Search

CPC ..... E05B 77/06; E05B 63/0069; E05B 81/90; Y10S 292/22

See application file for complete search history.

(56) References Cited

U.S. PATENT DOCUMENTS

| | | | |
|---|---|---|---|
| 3,583,741 | A | 6/1971 | Breitschwerdt et al. |
| 3,799,596 | A | 3/1974 | Nozomu et al. |

(Continued)

FOREIGN PATENT DOCUMENTS

| | | | |
|---|---|---|---|
| CN | 1946913 | A | 4/2007 |
| CN | 101666192 | A | 3/2010 |
| KR | 1020100077163 | A | 7/2010 |

OTHER PUBLICATIONS

Chinese Office Action for Patent Application No. 201401371284.5; dated Mar. 22, 2016; 12 pgs.

(Continued)

*Primary Examiner* — Mark A Williams
(74) *Attorney, Agent, or Firm* — Cantor Colburn LLP

(57) ABSTRACT

A vehicle door latch assembly is disclosed herein, having: a fork bolt movably secured to the latch assembly; a detent lever movably secured to the latch assembly, the detent lever being capable of movement between an engaged position and a disengaged position, the detent lever retains the fork bolt in a latched position when the detent lever is in the engaged position and an engagement surface of the detent lever contacts an engagement surface of the fork bolt; an inertia block out assembly for preventing the detent lever from moving into the disengaged position when the inertia (Continued)

block out assembly is in a blocking position; and a manual override mechanism for the inertia block out assembly, wherein the manual override mechanism requires at least three independent actions to be performed to move the inertia block out assembly from the blocking position to an unblocking position.

7 Claims, 11 Drawing Sheets

Related U.S. Application Data

(60) Provisional application No. 61/507,803, filed on Jul. 14, 2011.

(51) Int. Cl.

| | |
|---|---|
| ***E05B 77/06*** | (2014.01) |
| ***E05B 77/12*** | (2014.01) |
| ***E05B 81/28*** | (2014.01) |
| *E05B 81/06* | (2014.01) |
| *E05B 81/34* | (2014.01) |
| *E05B 81/40* | (2014.01) |
| *E05B 81/90* | (2014.01) |

(52) U.S. Cl.

CPC ..... *E05B 81/06* (2013.01); *E05B 81/34* (2013.01); *E05B 81/40* (2013.01); *E05B 81/90* (2013.01); *Y10T 29/49826* (2015.01); *Y10T 292/0946* (2015.04); *Y10T 292/0949* (2015.04)

(56) References Cited

U.S. PATENT DOCUMENTS

| | | | | |
|---|---|---|---|---|
| 3,969,789 | A | 7/1976 | Wize | |
| 4,422,522 | A | 12/1983 | Slavin et al. | |
| 5,474,339 | A * | 12/1995 | Johnson | E05B 81/06 292/201 |
| 5,564,761 | A * | 10/1996 | Mizuki | E05B 81/20 292/201 |
| 6,053,543 | A | 4/2000 | Arabia, Jr. et al. | |
| 6,502,870 | B1 * | 1/2003 | Luo | E05B 47/0012 292/201 |
| 6,568,741 | B1 | 5/2003 | Leung et al. | |
| 6,648,380 | B1 * | 11/2003 | Szablewski | E05B 81/14 292/201 |
| 6,712,409 | B2 * | 3/2004 | Monig | E05B 77/06 292/336.3 |
| 7,791,218 | B2 | 9/2010 | Mekky et al. | |
| 8,376,416 | B2 | 2/2013 | Arabia, Jr. et al. | |
| 8,398,128 | B2 | 3/2013 | Arabia et al. | |
| 2002/0163207 | A1 | 11/2002 | Rogers, Jr. et al. | |
| 2006/0261602 | A1 * | 11/2006 | Jankowski | E05B 77/12 292/216 |
| 2006/0261603 | A1 * | 11/2006 | Cetnar | E05B 77/06 292/216 |
| 2013/0015670 | A1 | 1/2013 | Perkins | |
| 2015/0069766 | A1 | 3/2015 | Estrada et al. | |

OTHER PUBLICATIONS

English Abstract for CN101666192A—Mar. 10, 2010; 2 pgs.
English Abstract for CN1946913—Apr. 11, 2007; 2 pgs.
English Translation of Chinese Office Action for Patent Application No. 201401371284.5; dated Mar. 22, 2016; 17 pgs.
Non-Final Office Action for U.S. Appl. No. 13/549,389, filed Jul. 13, 2012; dated Mar. 17, 2015; 9 pgs.
Korean Patent Application No. 10-2014-0097064 dated Aug. 30, 2016.
English Abstract for KR20100077163.
Machine Translation for KR20100077163.

* cited by examiner

VEHICLE DOOR LATCH

CROSS REFERENCE TO RELATED APPLICATIONS

This application is a divisional application of U.S. patent application Ser. No. 13/549,389 filed on Jul. 13, 2012, which claims the benefit of U.S. Provisional Patent Application No. 61/507,803 filed Jul. 14, 2011, the entire contents each of which are incorporated herein by reference thereto.

BACKGROUND

Exemplary embodiments of the present invention relate to door and movable panel latches and, more particularly, to door and movable panel latches for vehicles.

A vehicle frequently includes displaceable panels such as doors, hood, trunk lid, hatch and the like which are affixed for hinged or sliding engagement with a host vehicle body. Cooperating systems of latches and strikers are typically provided to ensure that such panels remain secured in their fully closed position when the panel is closed.

A door latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever is spring biased into the engaged position and thus, holds the fork bolt in the primary latched position when in the engaged position and releases the fork bolt when it is moved to the disengaged position so that the door can be opened.

The fork bolt is pivoted to the primary latched position by a striker attached to, for example, an associated door jamb when the door is closed. Once in the primary latched position, the detent lever engages the fork bolt to ensure the assembly remains latched.

Accordingly, it is desirable to provide a latch assembly wherein the detent lever is prevented from inadvertently being moved into a disengaged position.

SUMMARY OF THE INVENTION

In accordance with one exemplary embodiment of the invention, a latch assembly is provided. The vehicle latch assembly having: a fork bolt movably secured to the latch assembly, the fork bolt being capable of movement between a latched position and an unlatched position; a detent lever movably secured to the latch assembly, the detent lever being capable of movement between an engaged position and a disengaged position, the detent lever retains the fork bolt in the latched position when the detent lever is in the engaged position and an engagement surface of the detent lever contacts an engagement surface of the fork bolt; an inertia block out assembly for preventing the detent lever from moving into the disengaged position when the inertia block out assembly is in a blocking position; and a manual override mechanism for the inertia block out assembly, wherein the manual override mechanism requires at least three independent actions to be performed to move the inertia block out assembly from the blocking position to an unblocking position, wherein the detent lever is capable of being moved from the engaged position to the disengaged position when the inertia block out assembly is in the unblocking position.

In an alternative embodiment, a method of preventing a detent lever of a vehicle door latch assembly from moving to a disengaged position when the detent lever has been moved to an engaged position by a remotely activated actuator is provided. The method including the steps of: pivotally securing a fork bolt to the vehicle door latch assembly for movement between an unlatched position and a latched position; pivotally securing the detent lever to the vehicle door latch assembly for movement between the engaged position and the disengaged position wherein a contact surface of the detent lever engages a contact surface of the fork bolt when the detent lever is in the engaged position and the fork bolt is in the latched position; preventing the detent lever from moving into the disengaged position from the engaged position until an inertia block out assembly of the vehicle door latch is moved from a blocking position to an unblocking position; and moving the inertia block out assembly from a blocking position to an unblocking position, by a manual override mechanism, wherein the manual override mechanism requires at least three consecutive independent actions to be performed to move the inertia block out assembly from the blocking position to an unblocking position, wherein the detent lever is capable of being moved from the engaged position to the disengaged position when the inertia block out assembly is in the unblocking position.

In an alternative embodiment, a vehicle door latch assembly is provide, the vehicle door latch assembly having: a fork bolt movably secured to the latch assembly, the fork bolt being capable of movement between a latched position and an unlatched position; a detent lever movably secured to the latch assembly, the detent lever being capable of movement between an engaged position and a disengaged position, the detent lever retains the fork bolt in the latched position when the detent lever is in the engaged position and an engagement surface of the detent lever contacts an engagement surface of the fork bolt; an inertia block out assembly for preventing the detent lever from moving into the disengaged position when the inertia block out assembly is in a blocking position; and a manual override mechanism for the inertia block out assembly, wherein the manual override mechanism requires at least two consecutive independent actions to be performed to move the inertia block out assembly from the blocking position to an unblocking position, wherein the detent lever is capable of being moved from the engaged position to the disengaged position when the inertia block out assembly is in the unblocking position.

Additional features and advantages of the various aspects of exemplary embodiments of the present invention will become more readily apparent from the following detailed description in conjunction with the drawings wherein like reference numerals refer to corresponding parts in the several views.

Figure 1:
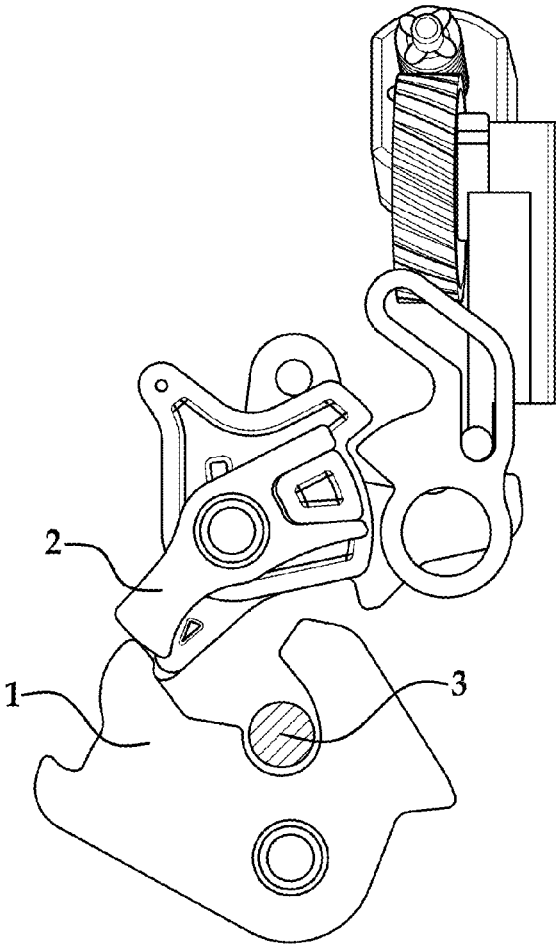
FIG. 1 illustrates a forkbolt and a detent of a vehicle latch in a latched position.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

Exemplary embodiments of the present invention relate to an apparatus and method for providing a latch assembly. Furthermore, exemplary embodiments are directed to a latch assembly having a fork bolt movably secured thereto for movement between a latched position and an unlatched position. The latch assembly further comprises a detent lever capable of movement between an engaged position and a disengaged position, the detent lever retains the fork bolt in the latched position when the detent lever is in the engaged position and an engagement surface of the detent lever contacts an engagement surface of the fork bolt. The latch assembly also includes an inertia block out assembly for preventing the detent lever from moving into the disengaged position until a predetermined force is applied to the detent lever to move it to the disengaged position when the fork bolt is in the latched position.

The door latch functions in a well-known manner to latch the door when it is closed and to lock the door in the closed position or to unlock and unlatch the door so that the door can be opened manually.

In general terms, the door latch has a forkbolt that engages a striker in the door jamb to latch the door when it is closed and a spring biased detent lever that engages and holds the forkbolt in the latched position. The door latch also typically has a release mechanism for moving the detent to a position releasing the forkbolt so that the door can be unlatched and opened and a lock-unlock mechanism for disabling the release mechanism to prevent unauthorized unlatching of the door.

In one non-limiting exemplary embodiment, the latch assembly is configured to block the detent lever in order to avoid any undesired opening especially when the latch or detent lever could be exposed to a high acceleration.

Reference is made to the following U.S. Pat. Nos. 3,969,789; 6,053,543 and 6,568,741 and U.S. Patent Publication No. 2002/0163207 the contents each of which are incorporated herein by reference thereto.

Inertia mechanisms have long been applied to vehicle door latch systems in an effort to control the motion of internal components in the event of a crash condition that would otherwise serve to retain the door to the body of the vehicle.

Since the structural and release mechanisms of most vehicle latches are manufactured from steel or structural thermoplastic resin, they all are susceptible to this form of inertial load and thus can release inadvertently.

Some forms of inertia mechanisms employ the use of a counter-balancing mass on a lever that, when a specified level of inertia is encountered, will translate or rotate a blocking member to effectively block out a specific latch or handle component resulting in an enhanced level of inertia performance. Other forms of inertia enhancement systems rely on electromechanical means (motor and gears, solenoid, etc.) to translate or rotate the aforementioned blocking member.

Both of the systems mentioned above have limitations such as the vector to which the inertia is applied, the level of inertia, corrosion, and system deformation.

One possible solution to the aforementioned inertial energy application is to employ a responsive system, much like air bag technology that is currently used in nearly every new vehicle produced. This type of system would react to energy levels instantaneously applied to the vehicle via a response from a form of sensory signal. Issues arise with this methodology due to the time required for said sensory event. Data shows that inertial loads created in a side impact crash event can happen nearly instantaneously, often breaching 10 mS. This brings into light the necessity of a reactive system that can sense, process and deliver an electric signal to a device that could effectively enhance the ability of a door latch system to retain the passenger door of a vehicle in this time window. Experts agree that the process time alone of such a system would be greater than the 10 mS target, thus making them ineffective for all side impact events.

Another sort of inertial energy mitigation device could come in the form of a more active system that senses the vehicles motion or velocity, as an example, to engage an electromechanical system. This approach could greatly enhance the capability of any vehicle to withstand, not only greater inertial loads from a crash or rollover event, but to withstand undesired release activation due to deformation of the vehicle body or the related mechanical release system. This deformation can also cause the aforementioned inadvertent release of a vehicle door latching system.

In either case, a reactive or active system, the desire is to be able to release the system after a crash event occurs. This would ease the egress of passengers possibly trapped in the vehicle after a crash or rollover event. This would entail a system that would reset itself after an event, or be capable of being mechanically overridden when desired.

It is therefore the purpose of this application, to define a desired system capability, and a method to achieve the desired performance. In addition, this application will describe a method of mechanically overriding a crashworthiness enhancement system, such that a passenger in a vehicle that encountered a crash or rollover event can release the latching system post-event.

For the purposes of this application, consider a conventional vehicle door latch construction that employs a structural feature rigidly secured to the body of the vehicle (striker), a rotating structural member within the door latch construction that engages with the striker (forkbolt lever) and another rotating structural member that engages with the forkbolt to constrain the forkbolt in a closed position (detent lever). By moving the detent to an open position, the forkbolt is then free to rotate to an open position, thus releasing the door from the body of the vehicle.

In accordance with various exemplary embodiments of the present invention, the detent lever, or other member of the latch release mechanism, is restrained from moving towards its open position due to the effects of high inertia forces or external forces applied to the release chain due to body deformation or release cable or rod deformation often encountered during a vehicle crash or rollover event.

In addition and as will be explained herein possible control methodologies with which to activate and deactivate the system are also contemplated.

Still further, a manner of manually disengaging the detent restraining device in the event of a loss of power to the mechanism will be described.

The door latch release mechanism in the context of the aforementioned description is any member or combination of members that are kinematically coupled to the detent lever so to move it to its open position. Hundreds of previous patents and publications attest to the possible combinations and permutations of this theme. It therefore can be said that if an auxiliary system were to block the release direction of the detent lever or any member or combination of members kinematically coupled to the detent, the door latch system inertia performance could be greatly enhanced. Moreover, if the auxiliary system were to block the release direction of the detent lever and effectively decouple the release members from the detent lever, the door latch system inertia performance could be greatly enhanced and the overall crashworthiness of the vehicle could be greatly improved by negating the effect of sheet metal or linkage activation of the release mechanism.

Figure 2:
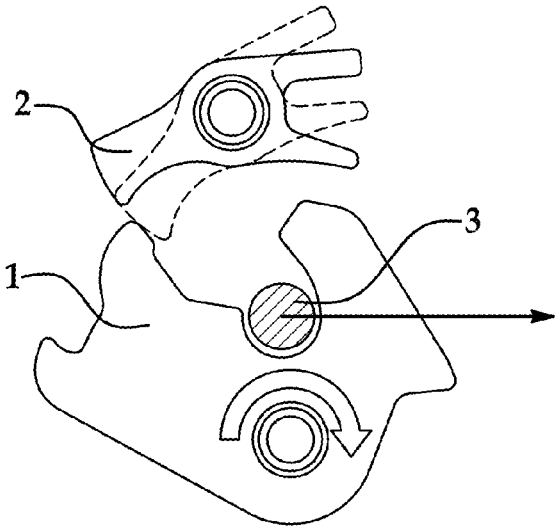
FIG. 2 illustrates a forkbolt and a detent of a vehicle latch in an unlatched position.

As shown in FIG. 1, is a typical layout of a forkbolt 1 and a detent 2 of a vehicle latch in a latched position. A striker 3 is represented in this FIG. by a cross section. If the detent lever 2 is rotated to the open position illustrated in FIG. 2, the forkbolt 1 would then be free to rotate to its open position thus releasing the striker 3 from the latch.

Figure 3:
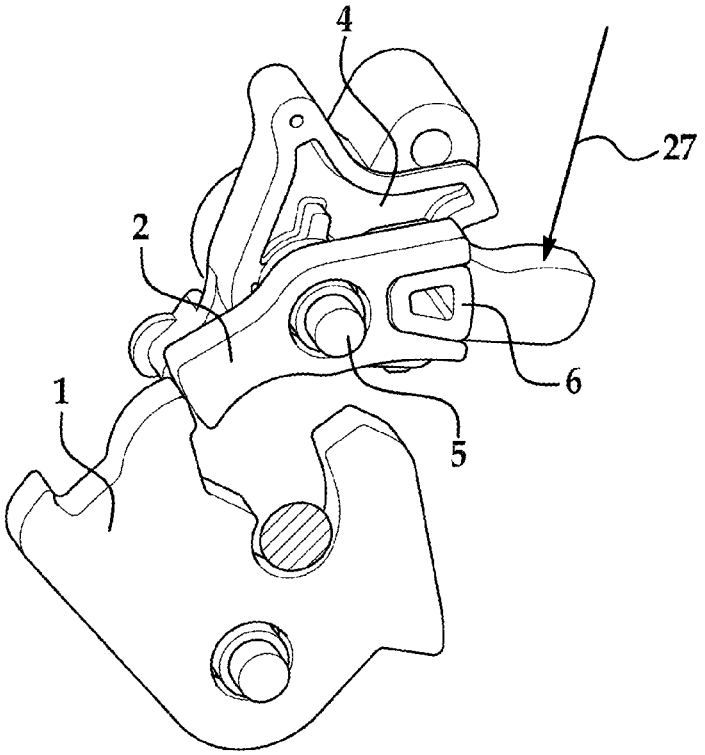
FIG. 3 illustrates a latch with a second lever rotating upon the same pivot as the detent lever.

Referring now to FIG. 3, consider a second lever 4 rotating upon the same pivot 5 as the detent lever 2 and coupled to the detent lever 2 by a feature 6 such that the two members rotate in an exact manner.

Figure 4:
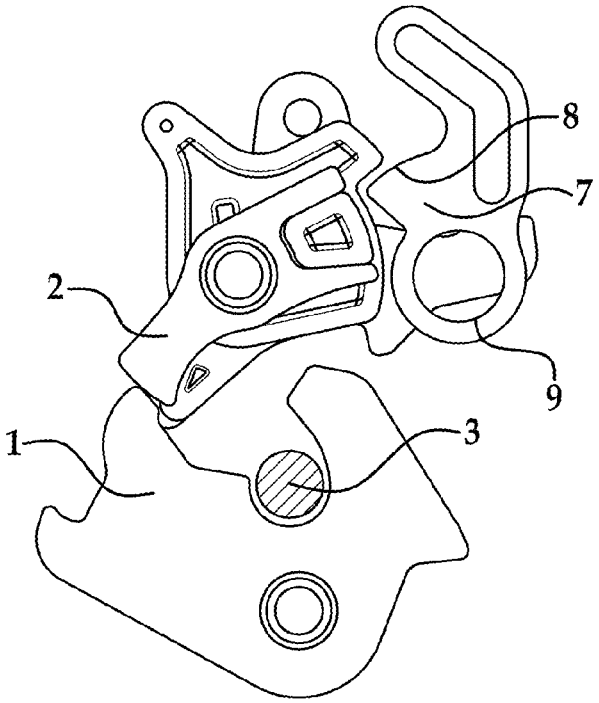
FIG. 4 illustrates a latch with a rotatable blocking member that impedes rotation of the detent lever to its open position when the blocking member is in the position illustrated in FIG. 4.

Still further and referring to FIG. 4, a blocking member 7 is provided and is able to rotate in such a manner that a portion 8 of the blocking member 7 impedes rotation of the detent lever 2 to its open position when the blocking member 7 is in the position illustrated in FIG. 4. The blocking member 7 is secured to, and pivots about a structural feature 9 of the door latch such that it will withstand any inertial loads which would otherwise serve to release the detent lever.

Figure 5:
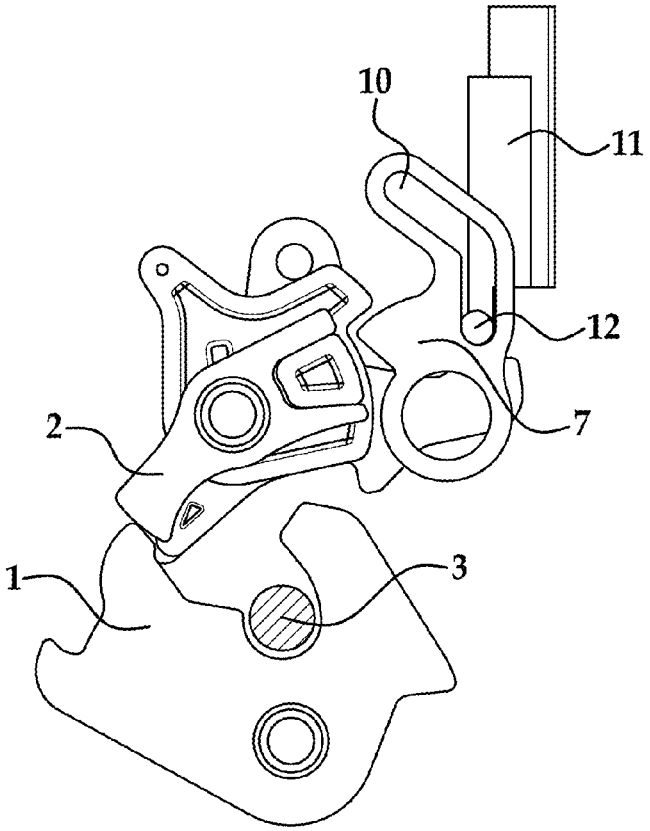
FIGS. 5 and 6 illustrate a linear cam arrangement or opening integral with the blocking member of the previous FIGS.
Figure 6:
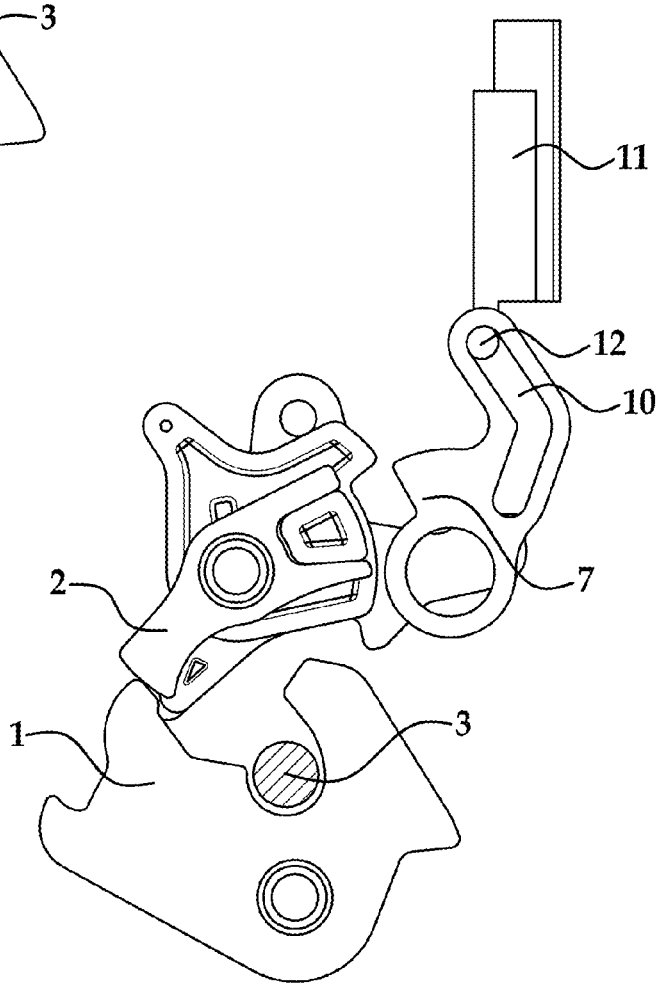

FIGS. 5 and 6 illustrate a linear cam arrangement or opening 10, integral with the aforementioned blocking member 7. In one contemplated embodiment, a sliding rack 11 has an integral cam driving feature 12 that interfaces or slides within the linear cam feature 10 of the blocking member, such that movement of the cam driving feature 12 in the cam feature 10 will rotate the blocking member 7 to a desired position when the sliding rack 11 is translated as depicted in FIGS. 5 and 6.

Figure 7:
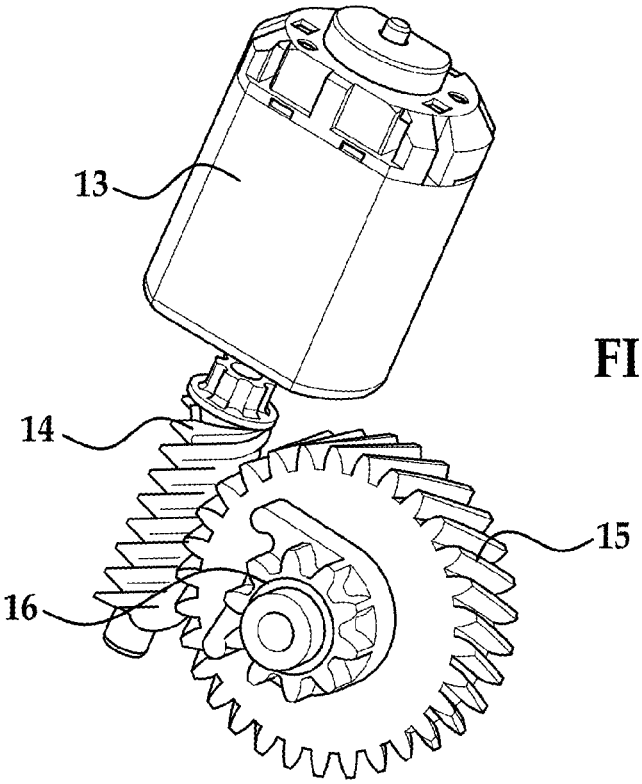
FIG. 7 illustrates an electromotive motor for use with a latch.
Figure 8:
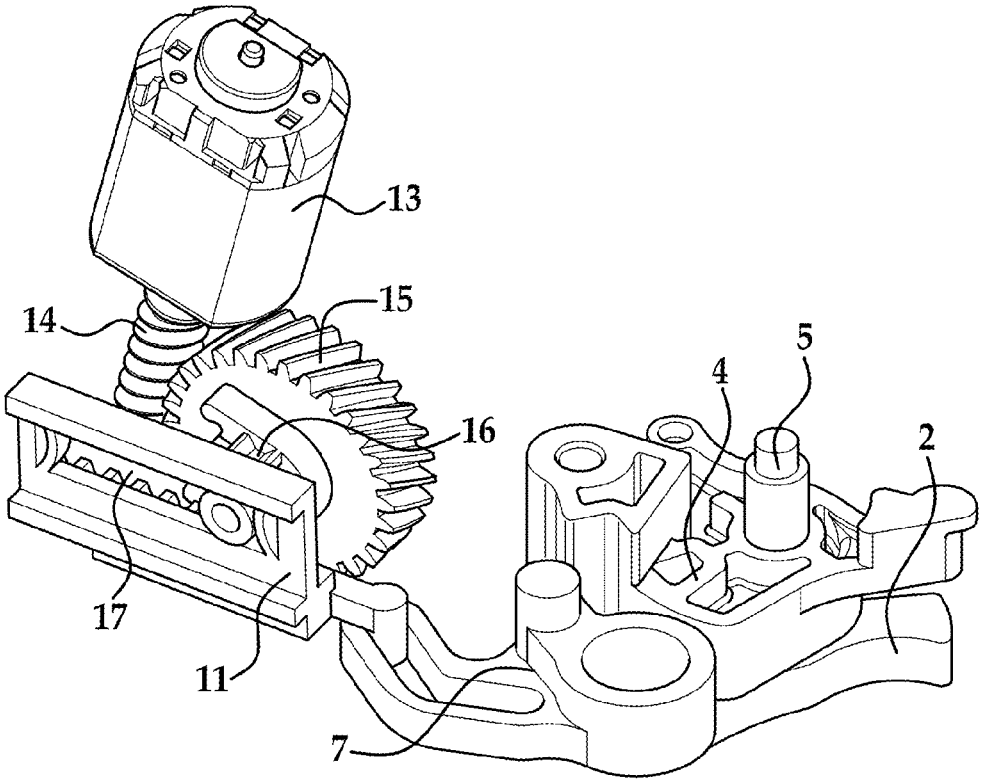
FIG. 8 illustrates the electromotive motor coupled to a sliding rack.

FIG. 7 illustrates an electromotive motor 13 that is coupled to a worm gear 14 that interfaces with a helical gear 15. Integral with the helical gear is a spur gear 16. FIG. 8 illustrates the electromotive motor 13 coupled to the sliding rack 11. Here the spur gear 16 is configured to interface with integrally molded gear teeth 17 on the sliding rack 11. Accordingly, the electromotive motor 13 can selectively place the blocking member 7 in the desired position to either operate in a conventional manner or block out the release direction of the detent lever thus negating the effect of inertia on the detent lever.

Figure 9:
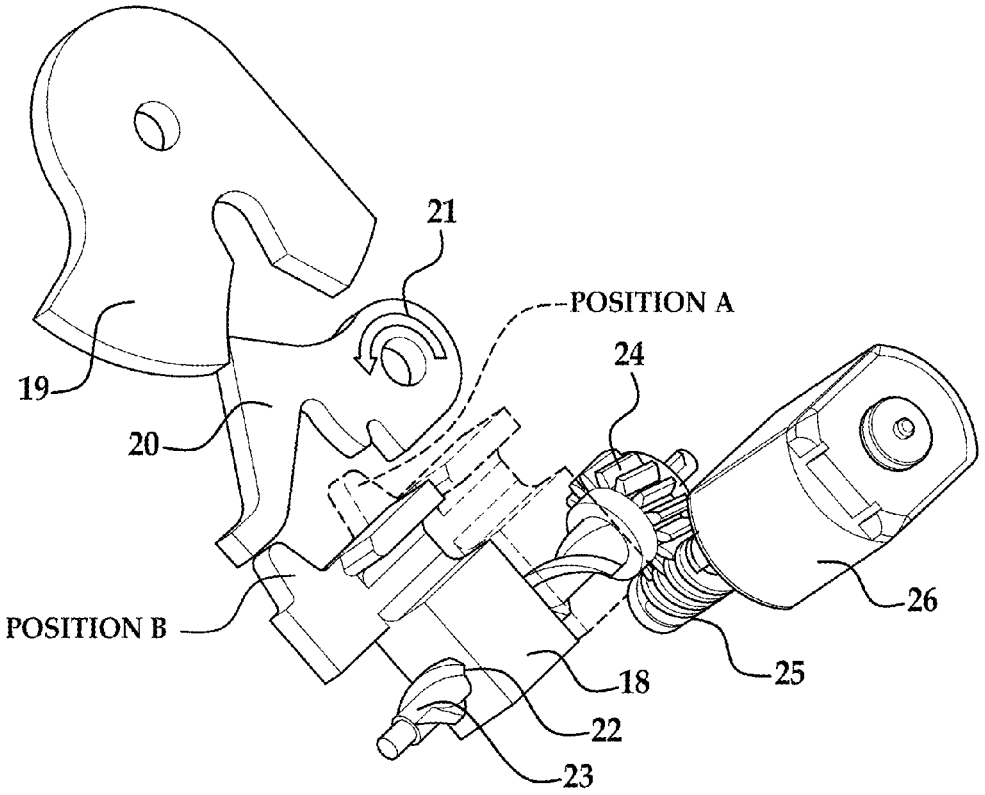
FIG. 9 illustrates an alternative exemplary embodiment of the present invention.

FIG. 9 illustrates an alternative exemplary embodiment of the aforementioned methodology. Here a translating blocking member 18 is used as opposed to a rotating blocking member. FIG. 9 also illustrates another forkbolt 19 and detent 20 geometry along with a release direction 21 of the detent lever. If the translating blocking member 18 was to travel to position A shown in dashed lines of FIG. 9, it is in a position to allow for the detent to move and function in a normal fashion. If however, the blocking member 18 is in the position B, the detent lever release direction would be compromised and thus blocking member 18 prevents travel of the detent to its release position.

In order to translate the blocking member 18 between positions A and B an integral, internal threaded portion 22 is provided. The internal threaded portion 22 is configured to interface and be driven by a power screw member 23 which allows the blocking element 18 to be selectively driven to a desired position by rotating the power screw member 23. In one non-limiting embodiment, the power screw member 23 has an integral helical gear 24 configured to interface with a worm gear 25, that is mechanically coupled to an electric motor 26. Accordingly, selective rotation of the motor would cause the subsequent translation of the blocking element into the desired positions.

While the systems shown in FIGS. 1-9 illustrate two possible solutions to enhance the load mitigation of inertial events, it does not address the potentially abusive load conditions that arise when a vehicle encounters a side impact collision. The deformation of the vehicle body during a side impact collision is often enough to deform the release cable or rod in such a manner as to release the mechanism or cause the sheet metal to impact the latch itself. Either one of these scenarios can cause extremely high loads upon the release system. One can imagine that if a blocking member were to be engaged with the detent lever under this type of loading condition, permanent deformation or catastrophic failure of the latch release system could easily occur. Therefore, it would be a more robust solution if the latch release mechanism were to be decoupled, in addition to the blocking member restraining the detent lever from moving to its release position.

For example, and referring to the forkbolt and detent lever geometry as described previously in FIGS. 1-3 a force 27 applied to this lever (hereinafter referred to as the detent release lever 6) from the release mechanism would cause a rotation on the detent lever to its release position due to the permanent coupling between these two members.

Figure 10:
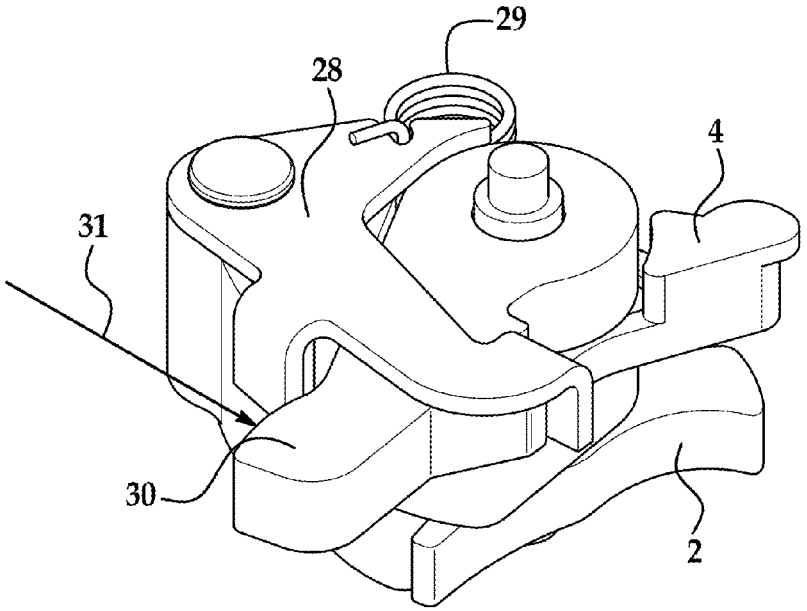
FIGS. 10-13 illustrate one possible non-limiting embodiment of such a decoupling device in accordance with one non-limiting embodiment of the present invention.

In an alternative embodiment, the detent release lever 6 is clutched to the detent blocking member 7 such that movement of the detent blocking member 7 also decouples the detent release lever 6 from the release mechanism. FIG. 10 illustrates one possible non-limiting embodiment of such a decoupling device. In this embodiment, the decoupling device comprises a detent release lever 4, a clutch lever 28, a return spring 29, and an input lever 30 movably displaced by the latch release mechanism (represented by vector 31).

Figure 11:
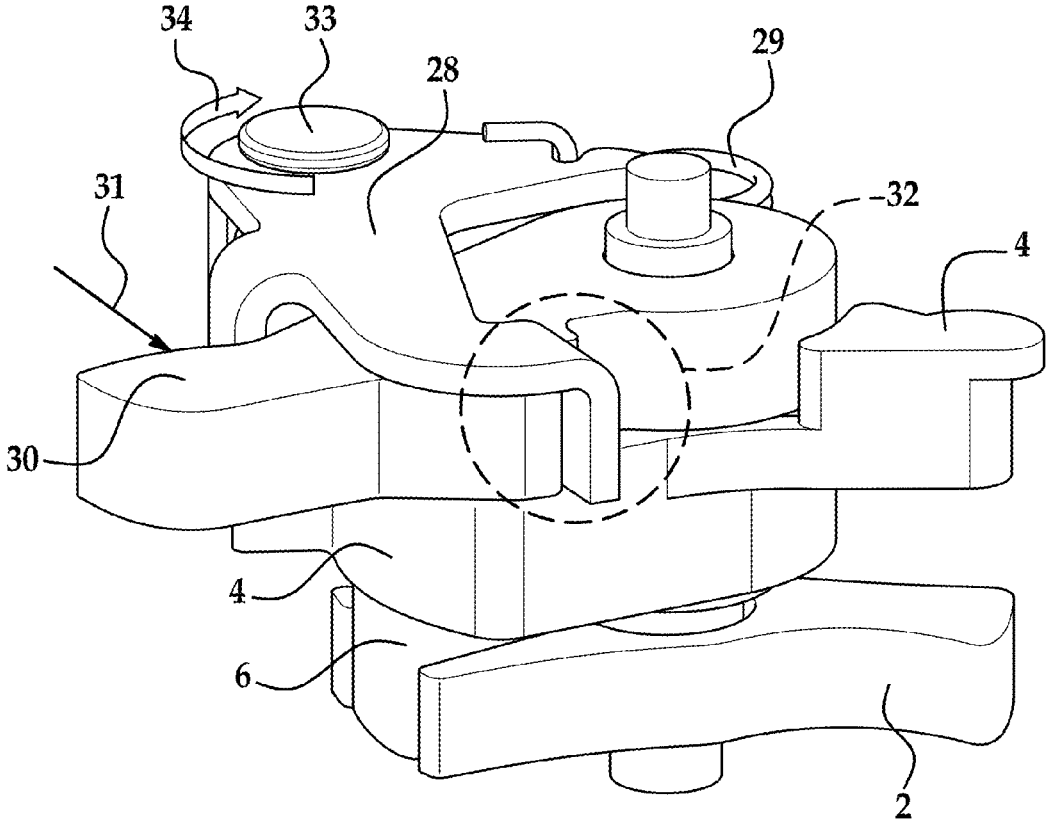

FIG. 11 depicts the detail between the detent lever 2, the detent release lever 4 and the input lever 30 shown in the engaged position 32. The detent release lever and the input lever are able to move independently unless they are coupled together via the clutch lever 28. The clutch lever is pinned to the detent release lever via a pin 33 such that it will travel rotationally with the detent release lever and can also rotate about pin 33. The clutch lever is spring biased in the direction of arrow 34 into the engaged position.

Figure 12:
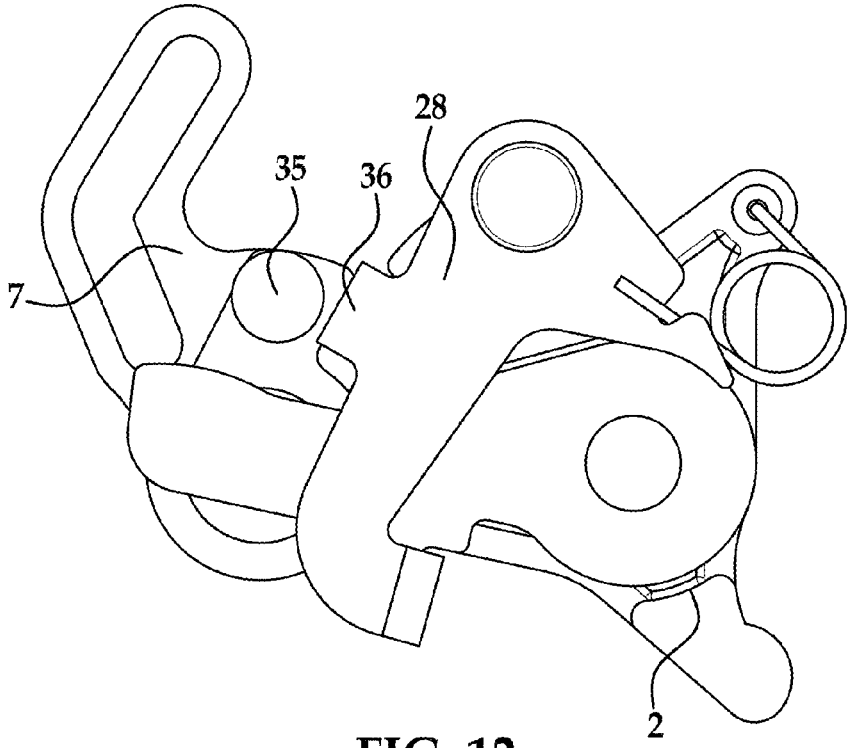
Figure 13:
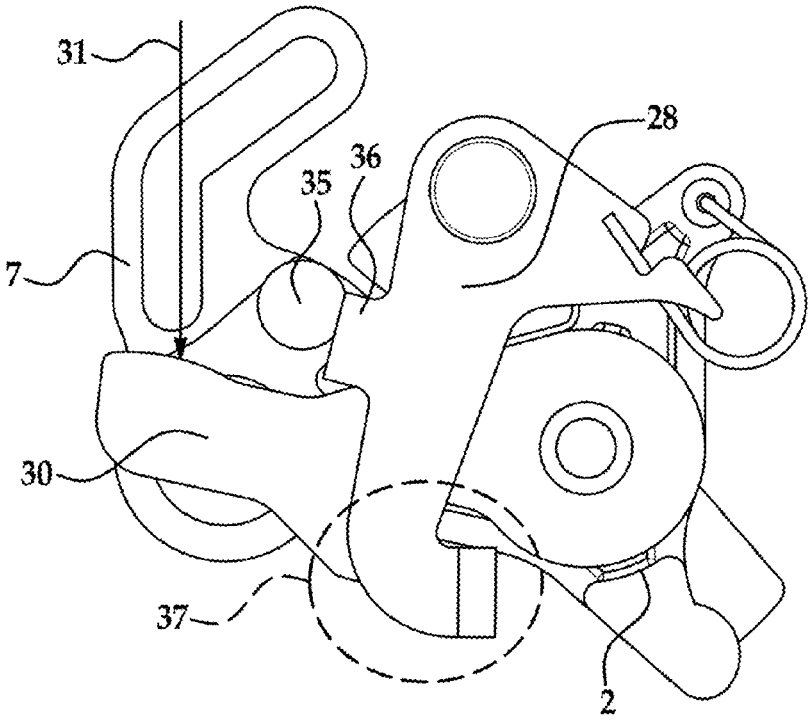

FIG. 12 illustrates the detent blocking member 7 having an integral feature 35 configured to interface with a mating contact surface 36 of the clutch lever 28. Accordingly, rotation or translation of the blocking member 7 to its engaged position (FIG. 13) drives the clutch lever 28 to a position such that the detent release lever and the input lever are now decoupled as illustrated by area 37. Once the input lever 30 is decoupled from the detent release lever, movement or a force from the latch release mechanism in the direction of arrow 31 would not be transferred to the detent lever or the blocking member and thus the abusive stresses that would normally be caused from inadvertent release activation are removed from the latch.

To this point, it has been assumed that the electric motor will receive energy via a controller to engage or disengage the blocking member. If however, the blocking member is engaged and an event occurs that severs power to the controller or to the vehicle door latch, a passenger will not be able to open the door under any normal circumstance. Therefore and in one exemplary embodiment, a manual over ride system, or energy back up system, is provided in the event of such an occurrence.

When considering a manual over ride mechanism for a detent lever blocking/release mechanism decoupling device, an issue of relevance occurs. If a passenger or inadvertent release activation were able to disengage the blocking member, it would defeat the purpose of this invention which is to greatly enhance the inertial and crashworthiness performance of the vehicle. However, when subjected to the stresses of a crash event, a human is less likely to process the required steps to reveal an auxiliary release mechanism and instead defaults to the existing release handle. Therefore, an override mechanism somehow co joined to the conventional release mechanism is desirable. However, in a crash or rollover event there may be several inertia impulses or linkage activation events capable of releasing the door latch mechanism that could override the blocking member if the override mechanism were co joined to the conventional release chain of the door latch.

Accordingly and in one exemplary embodiment, a feature of this manual over ride methodology requires multiple release motions to return the blocking member to its disengaged position and allow egress from the vehicle.

In one non-limiting embodiment, the release motions must be consecutive. For example, the design illustrated in FIG. 14 uses a three consecutive release motion methodology; however any number of release motions could theoretically be implemented.

Figure 14:
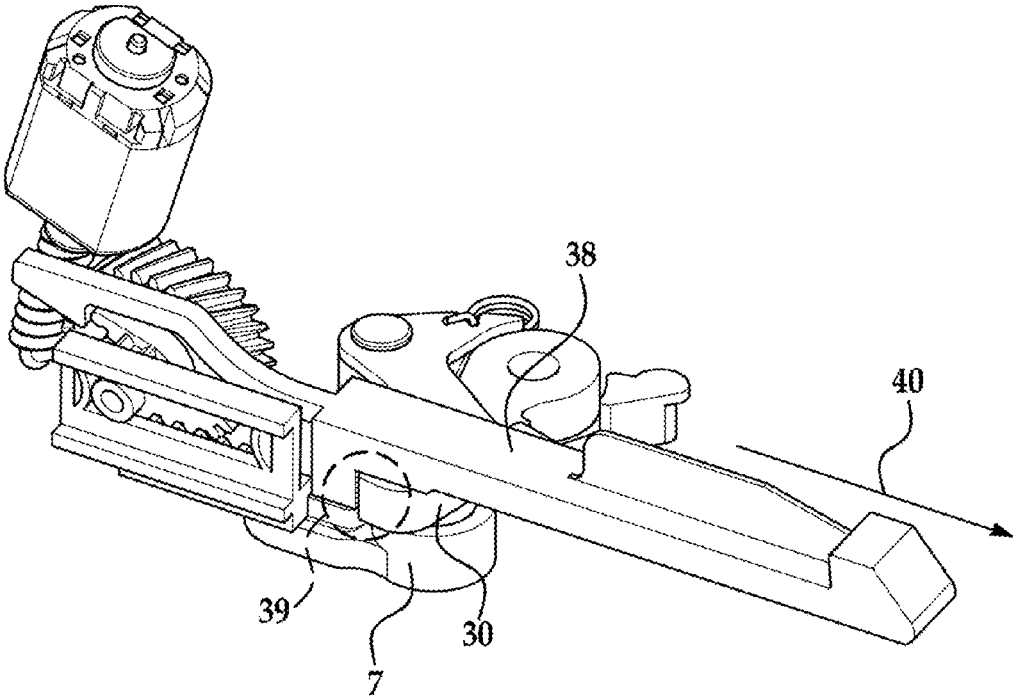
FIGS. 14-17 illustrate an alternative exemplary embodiment of the present invention.

For example, and referring to the motor/worm gear/helical gear arrangement as previously depicted in FIG. 7 and referring to FIG. 14, a release mechanism lever or link 38 interfaces (see area 39) with the input lever 30 of the detent release mechanism 38 such that translation of the release link 38 in the direction of arrow 40 would transfer work energy to the detent, thus releasing the door. However, this only occurs when the detent blocking member is disengaged. The aforementioned motion is considered one of the three aforementioned release motions.

In the event of an engaged detent blocking member 7, the force of the release mechanism input would provide no work or movement to the detent.

Figure 15:
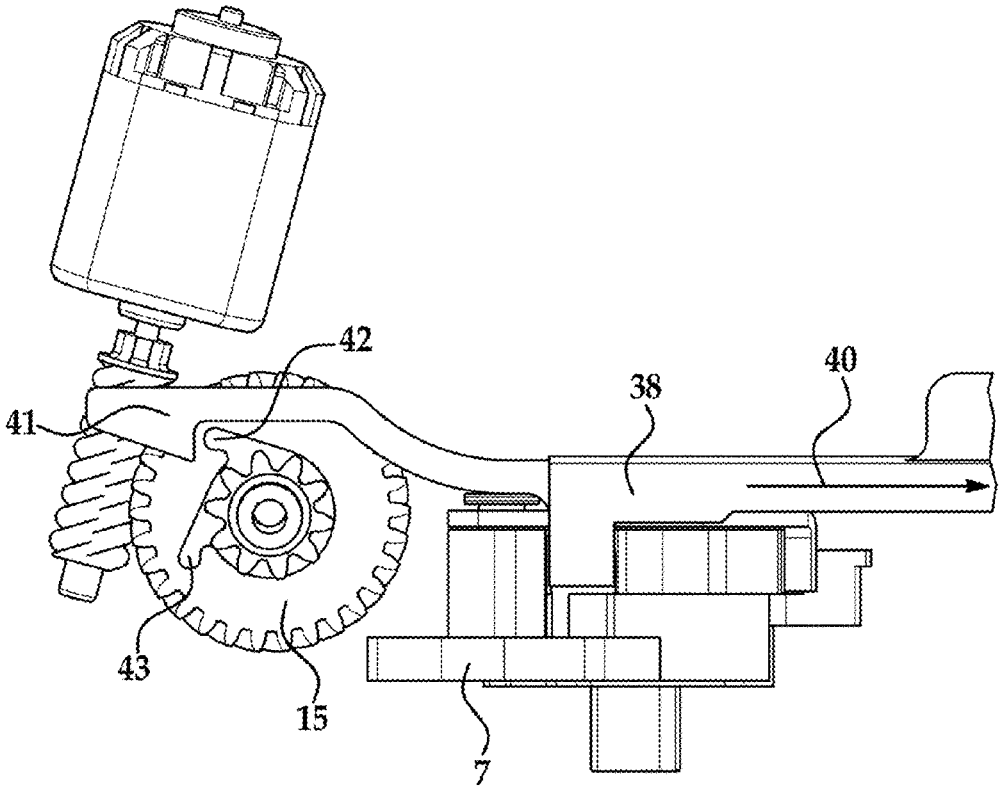

Referring now to FIG. 15, the release link 38 is also configured to have a feature 41 that interfaces with a complementary back drive feature 42 integral to the helical gear 15. As depicted and in one exemplary embodiment the feature is an integral, flexible feature, however, a separate component could be adopted to perform the same function. When the blocking member 7 is engaged such that such translation of the release link 38 would provide no force or work to the detent, the helical gear would be in a specific location relative to the position of the blocking member thus exposing the feature 42 or back drive "cogs" labeled as 42 and 43 for engagement with the release link 38.

Thus, if the release link 38 and its associated interface feature 41 are translated in the direction of arrow 40 to the release position (FIG. 16) the link interface feature 41 would engage the gear back drive feature 42 and subsequently rotate the helical gear 15 in the direction of arrow 44. This would cause the helical gear 15 to move a predetermined amount, thus translating the driving rack 11 coupled to the helical gear 15 a predetermined distance. The aforementioned motion is also considered one of the three aforementioned release motions. This back drive motion of the helical gear 15 would then expose the next cog 43 of the integral back drive features for engagement by release link 38 when it is moved a second time. This motion is also considered one of the three aforementioned release motions.

Figure 16:
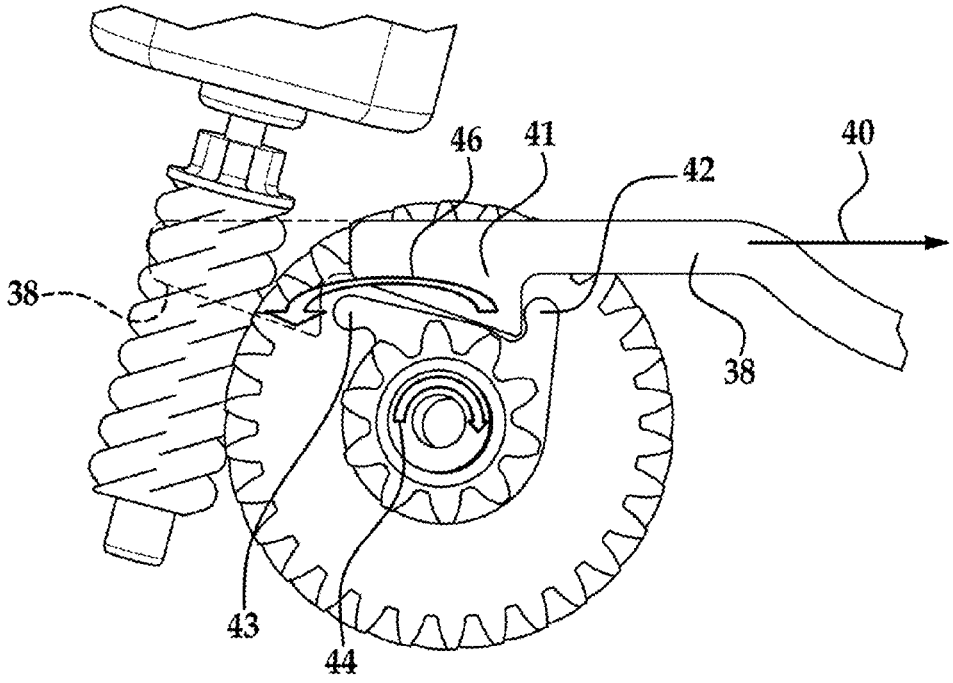

Accordingly and upon returning the release link 38 back to its home position illustrated by the dashed lines in FIG. 16, the link interface feature 41 would index over the cog 43 in the direction of arrow 46 and the subsequent back drive feature 43 on the helical gear thus re-engaging the back drive mechanism to the helical gear 15 such that subsequent release motions applied to the release link 38 would cause the helical gear 15 to be "ratcheted" back to its disengaged position.

Once the helical gear 15 is in the disengaged position, translation of the release link 38 in the direction of arrow 40 would transfer work energy to the detent, thus releasing the door, this being considered one of the three aforementioned release motions. Accordingly, the system illustrated in FIGS. 14-17 employs a three release motion event to fully release the latch from the vehicle body. In accordance with one non-limiting exemplary embodiment, the three release motion event is achieved by actuating or pulling a release lever (inside or outside) three consecutive times such that upon pulling of the release lever for the third time will cause the release link to transfer the work energy to the detent and thus release the door by opening the latch. In other words, two of the aforementioned release motions reposition the initial blocking system or block out assembly into an unblocking position such that the third release motion will transfer the work energy to the detent and open the latch.

Figure 17:
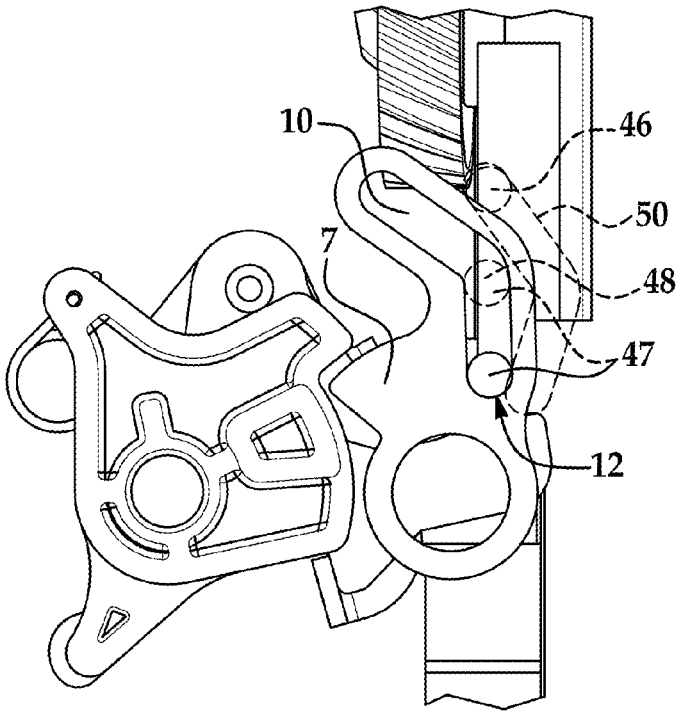

Referring now to FIG. 17 and in order to further illustrate this feature, the blocking member 7 has a dwell portion 47 integral with its linear cam slot, thus the first motion of the release link, as mentioned above when the detent blocking member 7 is in the engaged position 7 applies no work or force to the blocking member.

Moreover and as illustrated, integral cam driving feature 12 is received within the linear cam slot 10 of the sliding rack 11 thus the first release motion of the release link 38 moves the dwell portion 47 to the position 48 and no work or movement is applied to the blocking member. However and upon a second release motion of the release link, the dwell portion 47 is moved from position 48 to position 49 and the blocking member is now driven to its disengaged position illustrated by reference numeral 50. Then a subsequent third release motion of the release link would release the detent lever from its latched position.

Accordingly, the system illustrated in FIGS. 14-17 employs a three release motion event to fully release the latch from the vehicle body, when the detent blocking member 7 is in the engaged position and the release mechanism is actuated. Although specific configurations are illustrated in the attached figures it is understood that variations of the configurations illustrated herein are contemplated to be within the scope of exemplary embodiments of the present invention. For example, although a specific configuration of an apparatus employing the aforementioned three release motion event to fully release the latch from a vehicle body when a detent blocking member or detent is in a blocking position is illustrated. It is, of course, understood that variations of the illustrated configurations may be employed to achieve the same results namely, releasing a latch from a vehicle body when a detent blocking member or detent is in a blocking position after a predetermined (e.g., three or greater than three or less than three) consecutive motion events occur through repeated actuation of a member or link coupled to a release lever (inner or outer or both) of the vehicle latch. In other words, movement of a component of the latch a predetermined amount of times will in one non-limiting exemplary embodiment reposition components of the vehicle latch into two different states and/or configurations, one after the other, such that the next movement of the component of the latch after the two previous motions will transition the latch from a latch state to an open state such that a vehicle door associated therewith can be opened.

In an alternative embodiment, a two release motion event to fully release the latch from a vehicle body when a detent blocking member or detent is in a blocking position is provided. For example and in one embodiment, gear 15 may be configured with only a single cog 42 such that a single movement of the manual release mechanism (e.g., translation of release link 38) will move the blocking member to its disengaged position such that a subsequent movement of the manual release mechanism (e.g., translation of release link 38 again after it returns to its original position) will cause the initial blocking system or block out assembly to be in an unblocking position such that a second release motion will transfer the work energy to the detent and open the latch.

Figure 18A:
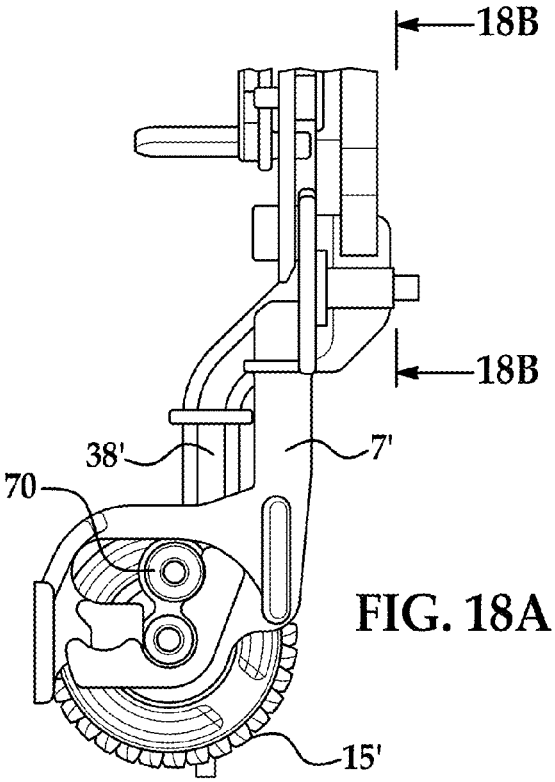
FIG. 18A illustrates yet another alternative exemplary embodiment of the present invention.
Figure 18B:
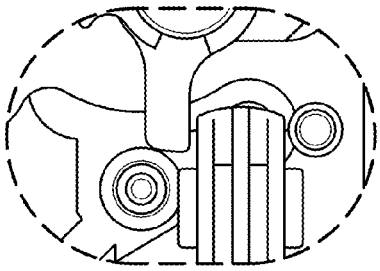
FIG. 18B is a view along lines 18B-18B of FIG. 18A.
Figure 18C:
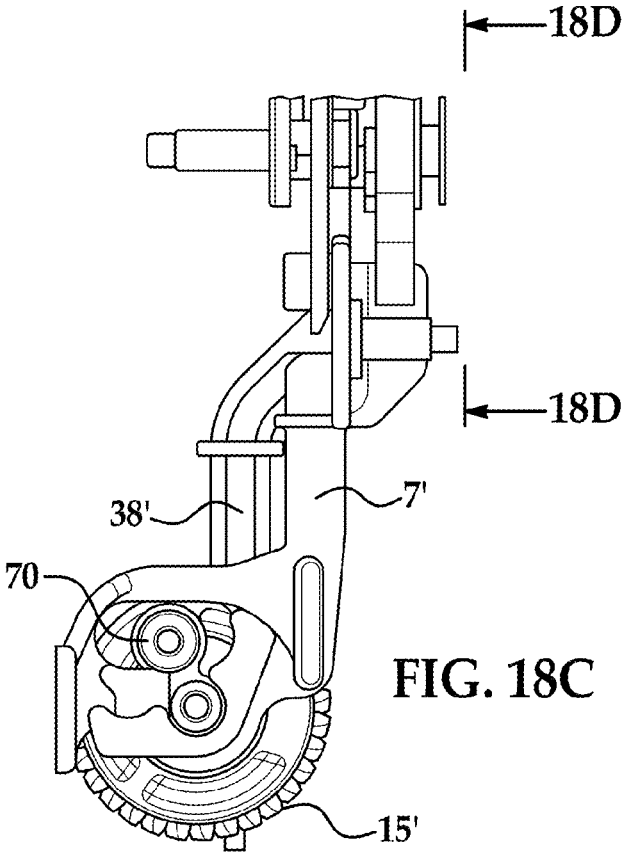
FIG. 18C illustrates another alternative embodiment of the present invention.
Figure 18D:
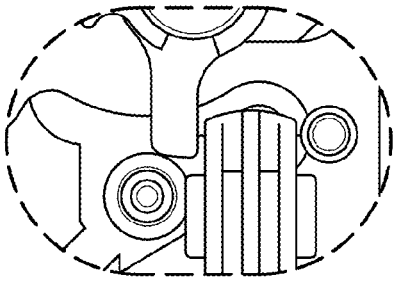
FIG. 18D is a view along lines 18D-18D of FIG. 18C.

Another alternative exemplary embodiment and configuration is illustrated in FIGS. 18A-18F and FIG. 19, here the system only again requires two consecutive release motion events in order to release the latch. In addition, the system illustrated in FIGS. 18A-18F and 19 also contemplates incomplete or partial release motions, which may be attributable to incomplete or partial movements of a release lever or vibrations, forces, and/or impacts to the system. This position or configuration is illustrated in FIGS. 18C and 18D.

In FIGS. 18A and 18B the blocking member or block out link 7' is in the engage position (e.g., the force of the release mechanism input would provide no work or movement to the detent). This is also true for the position illustrated in FIGS. 18B and 18C and thus force of the release mechanism input would provide no work or movement to the detent even though there has been some partial movement of a feature 70 of an output gear 15' as well as gear 15'.

Figure 18E:
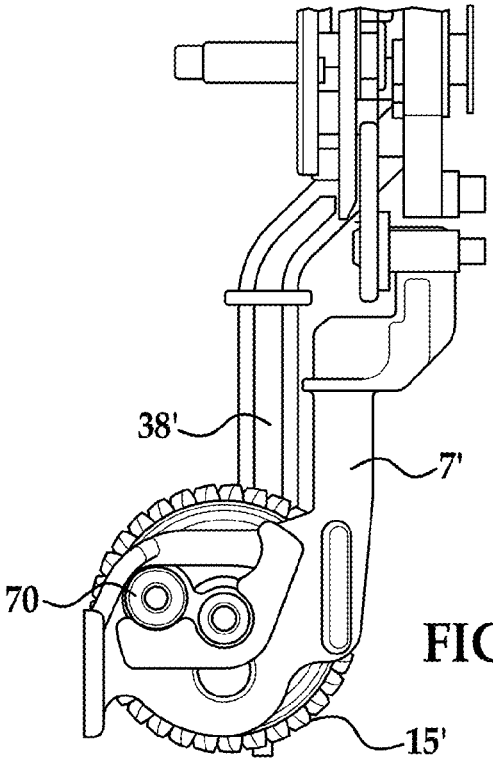
FIG. 18E illustrates another alternative embodiment of the present invention.
Figure 19:
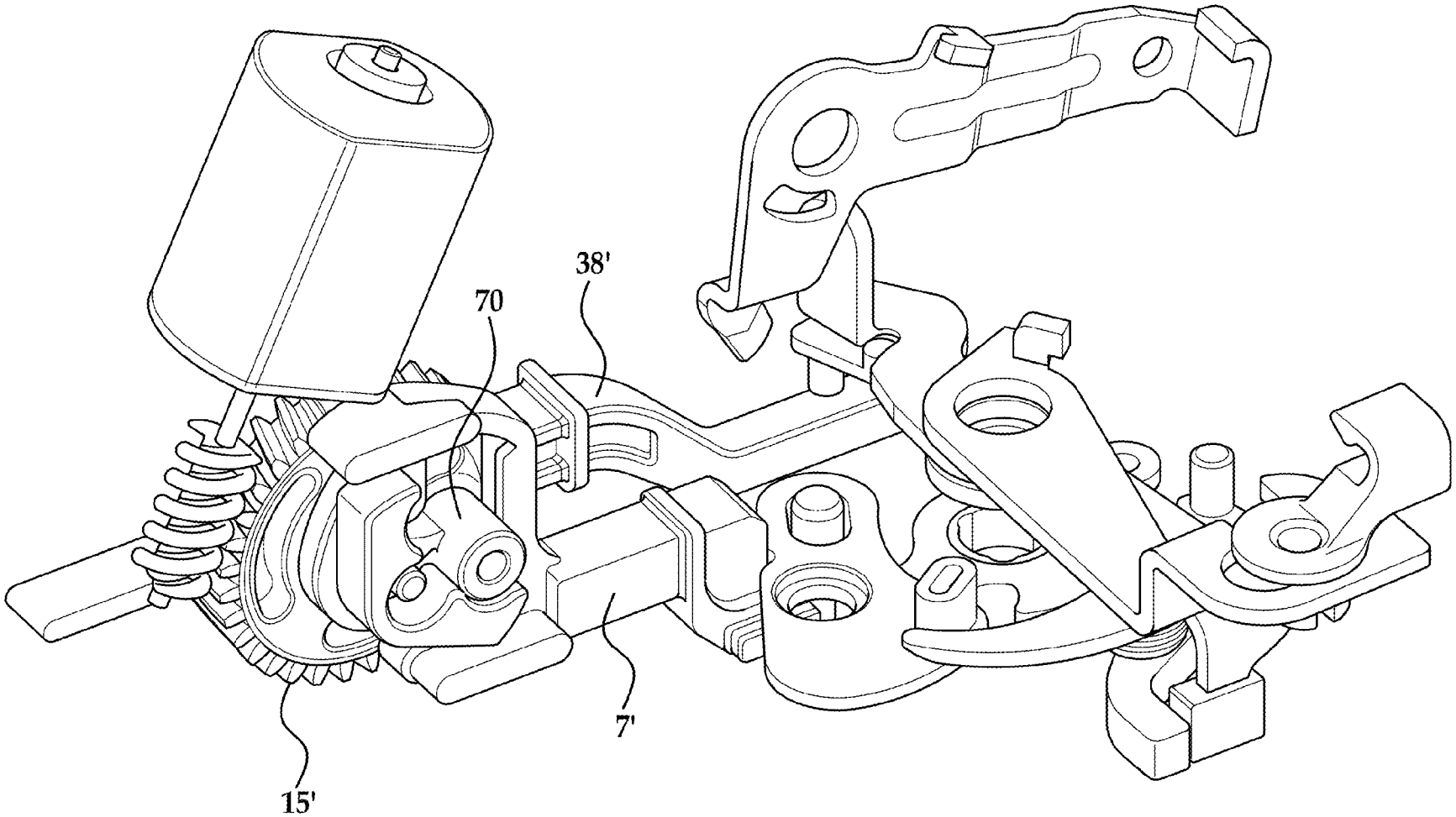
FIG. 19 is perspective view of the mechanism illustrated in FIGS. 18A-18E.

FIGS. 18D and 18E illustrate the configuration of the inertia block out assembly after a full first release motion of the manual override illustrated in FIGS. 18A-18E and FIG. 19. Thus, subsequent movement of the manual override (release link 38') from here (FIG. 18E) will cause the force of the release mechanism input provide to work or movement to the detent such that this movement will transition the latch from a latch state to an open state wherein a vehicle door associated therewith can be opened.

In view of the above alternative embodiments, the attached claims are not intended to be limited to the specific configurations illustrated in the attached drawings unless a specific literal reference to components of the specific configurations illustrated in the attached drawings appears in the claim.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of preventing a detent lever of a vehicle door latch assembly from moving to a disengaged position when the detent lever has been moved to an engaged position by a remotely activated actuator, the method comprising:

pivotally securing a fork bolt to the vehicle door latch assembly for movement between an unlatched position where the fork bolt does not engage a striker and a latched position where the fork bolt engages the striker;

pivotally securing the detent lever to the vehicle door latch assembly for movement between the engaged position and the disengaged position wherein a contact surface of the detent lever engages a contact surface of the fork bolt when the detent lever is in the engaged position and the fork bolt is in the latched position;

preventing the detent lever from moving into the disengaged position from the engaged position until an inertia block out assembly of the vehicle door latch is moved from a blocking position to an unblocking position; and moving the inertia block out assembly from a blocking position to an unblocking position, by a manual override mechanism, wherein the manual override mechanism must be actuated at least three consecutive times in order to move the inertia block out assembly from the blocking position to an unblocking position, wherein the detent lever is capable of being moved from the engaged position to the disengaged position when the inertia block out assembly is in the unblocking position.

2. The method as in claim 1, wherein the inertia block out assembly further comprises:

a blocking member that is able to rotate in such a manner that a portion of the blocking member impedes rotation of the detent lever when the blocking member is in a blocking position, the blocking lever being in the blocking position when the inertia block out assembly is in the blocking position.

3. The method as in claim 2, wherein the inertia block out assembly further comprises: a sliding rack having an integral cam driving feature that is configured to slidably engage a cam opening integrally formed in the blocking member and wherein movement of the cam driving feature in the cam opening causes movement of the blocking member between the blocking position and an unblocking position.

4. The method as in claim 3, further comprising: an electromotive motor for driving a helical gear coupled to the sliding rack.

5. The method as in claim 1, wherein the inertia block out assembly further comprises:

a blocking member that impedes rotation of the detent lever when the blocking member is in a blocking position, the blocking lever being in the blocking position when the inertia block out assembly is in the blocking position and wherein the blocking member has an internal threaded portion configured to interface and be driven by a power screw member coupled to motor.

6. The method as in claim 1, wherein the inertia block out assembly further comprises:

a blocking member that is able to rotate in such a manner that a portion of the blocking member impedes rotation of the detent lever when the blocking member is in a blocking position, the blocking lever being in the blocking position when the inertia block out assembly is in the blocking position; and a detent release lever configured to move the blocking member between the blocking position and an unblocking position, wherein the detent release lever is clutched to the blocking member by a decoupling device such that movement of the detent blocking member also decouples the detent release lever 6 from a release mechanism of the latch.

7. The method as in claim 6, wherein the decoupling device further comprises: the detent release lever, a clutch lever, a return spring, and an input lever movably displaced by the release mechanism of the latch, wherein the detent release lever and the input lever are capable of independent movement unless they are coupled together via the clutch lever when the clutch lever is in an engaged position.

* * * * *